US008810152B2

(12) United States Patent
Hsieh

(10) Patent No.: US 8,810,152 B2
(45) Date of Patent: Aug. 19, 2014

(54) LIGHT EMITTING DIODE MODULE

(71) Applicant: Habitex Corporation, Taipei (TW)

(72) Inventor: Pei-Lin Hsieh, Taipei (TW)

(73) Assignee: Habitex Corporation, Taipei (TW)

( * ) Notice: Subject to any disclaimer, the term of this patent is extended or adjusted under 35 U.S.C. 154(b) by 0 days.

(21) Appl. No.: 13/791,377

(22) Filed: Mar. 8, 2013

(65) Prior Publication Data

US 2014/0132178 A1 May 15, 2014

(30) Foreign Application Priority Data

Nov. 9, 2012 (CN) ..... 2012 2 0591817 U

(51) Int. Cl.
*H05B 37/02* (2006.01)
*H05B 33/08* (2006.01)

(52) U.S. Cl.
CPC ..... *H05B 33/0806* (2013.01)
USPC ..... 315/291; 315/308

(58) Field of Classification Search
CPC ..... F21V 9/00; F21V 13/00; F21S 4/00; H01J 9/24; H05B 37/02
USPC ..... 315/185 R, 193, 291, 307, 308, 312, 320
See application file for complete search history.

(56) References Cited

U.S. PATENT DOCUMENTS 8,299,716 B2 * 10/2012 Melzner et al. ..... 315/113
2009/0273930 A1 * 11/2009 Kraus ..... 362/257

* cited by examiner

*Primary Examiner* — Jimmy Vu
(74) *Attorney, Agent, or Firm* — Frommer Lawrence & Haug LLP; Ronald R. Santucci

(57) ABSTRACT

A light emitting diode module includes a circuit board, a light-emitting-diode (LED) unit, a light-adjusting unit and a conductive trace. The LED unit is directly mounted on the circuit board. The light-adjusting unit is directly mounted on the circuit board at a position distinct from a mounting portion of the LED unit on the circuit board, and is operable to adjust electric current flowing through the LED unit. The conductive trace is disposed on the circuit board for electrically connecting the LED unit to the light-adjusting unit.

4 Claims, 4 Drawing Sheets

LIGHT EMITTING DIODE MODULE

CROSS-REFERENCE TO RELATED APPLICATION

This application claims priority of Chinese Application No. 201220591817.7, filed on Nov. 9, 2012.

BACKGROUND OF THE INVENTION

1. Field of the Invention

The present invention relates to a light emitting diode module, more particularly to a light emitting diode (LED) module provided with a light-adjusting unit.

2. Description of the Related Art

In general, brightness of emitted light of a light emitting diode (LED) is decided by an amount of electric current flowing therethrough. Therefore, a conventional LED lamp is typically provided with a power converter to adjust the electric current transmitted from a power supply to LED(s) thereof so as to adjust the brightness of the LED(s).

Referring to FIGS. 1 and 2, a conventional LED lamp 1 includes a base 11, a support 12 extending upwardly from the base 11, a lampshade 13 supported by the support 12, a power converter 14 configured to be electrically connected to a receptacle 15, and a conventional LED module 16 disposed in the lampshade 13. The LED module 16 includes a circuit board 161 and a plurality of LEDs 162 disposed thereon. The LED lamp 1 further includes a light-adjusting unit including a light-adjusting circuit 17, and a knob 18 that is user-operable for adjusting brightness of the LEDs 162.

However, in the conventional LED lamp 1, the light-adjusting circuit 17 is generally disposed in the power converter 14, and the light-adjusting circuit 17 and the knob 18 are generally separated from the LED module 16. Therefore, manufacture of the conventional LED lamp 1 is relatively complicated such that manufacturing cost thereof is increased.

SUMMARY OF THE INVENTION

Therefore, an object of the present invention is to provide a light-emitting-diode (LED) module that may alleviate the above drawbacks of the prior art.

According to the present invention, an LED module comprises a circuit board, a LED unit, alight-adjusting unit, and a conductive trace. The LED unit is directly mounted on the circuit board. The light-adjusting unit is directly mounted on the circuit board at a position distinct from a mounting portion of the LED unit on the circuit board, and is operable to adjust electric current flowing through the LED unit. The conductive trace is disposed on the circuit board for electrically connecting the LED unit to the light-adjusting unit.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
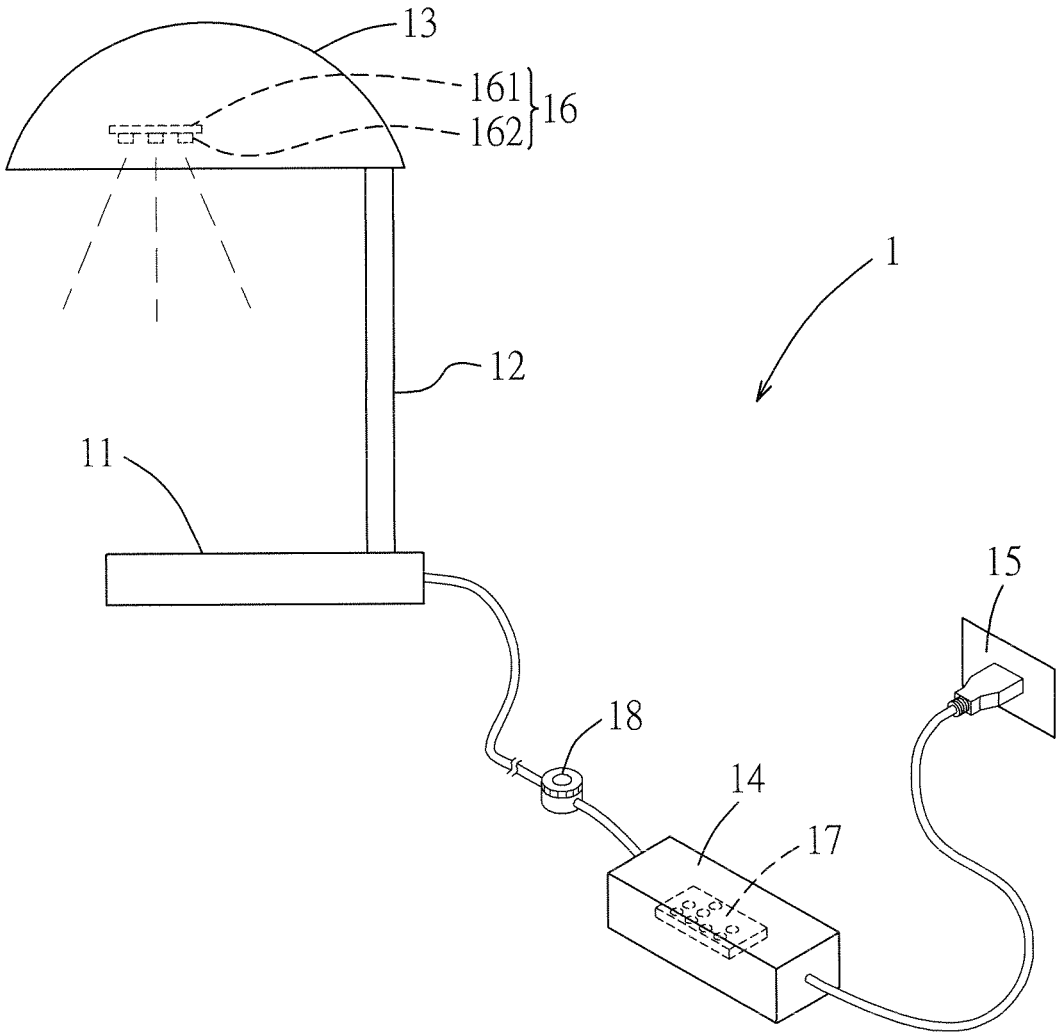
FIG.1 PRIOR ART
FIG. 1 is a schematic view of a conventional light-emitting-diode (LED) lamp.
Figure 2:
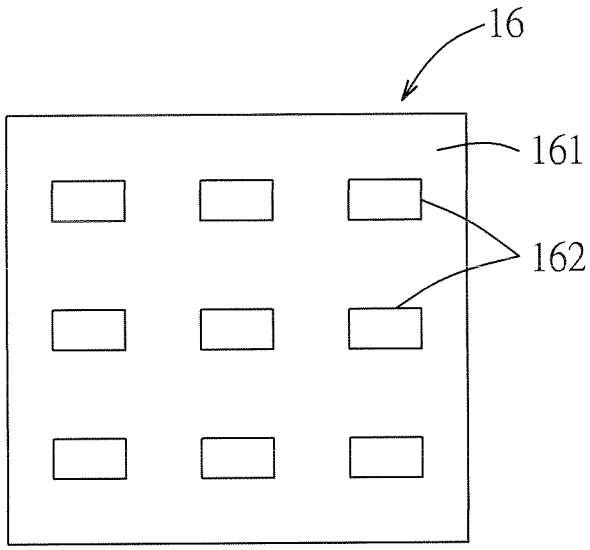
FIG.2 PRIOR ART
FIG. 2 is a schematic view of a LED module of the conventional LED lamp.
Figure 3:
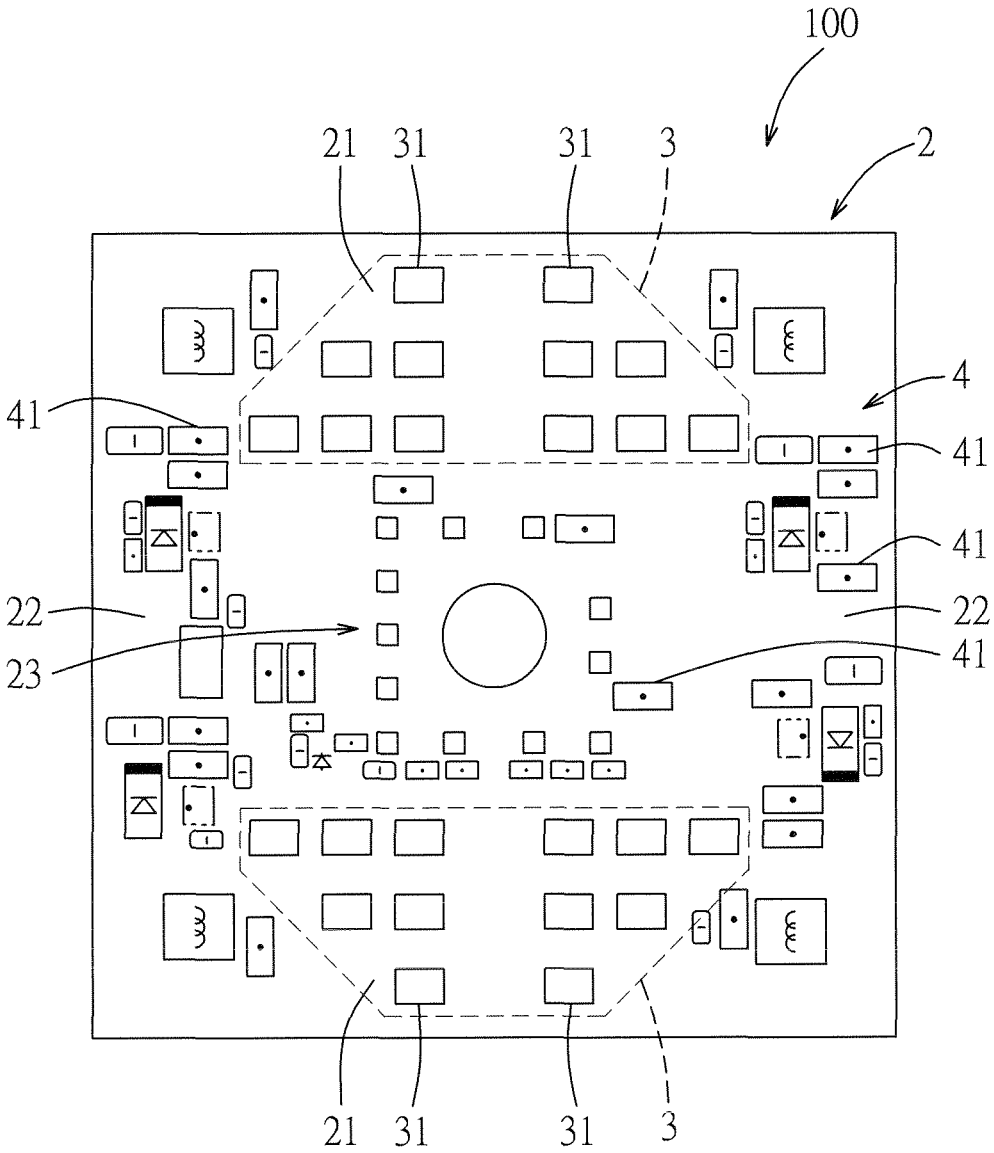
FIG. 3 is a schematic view of a preferred embodiment of an LED module of the present invention.
Figure 4:
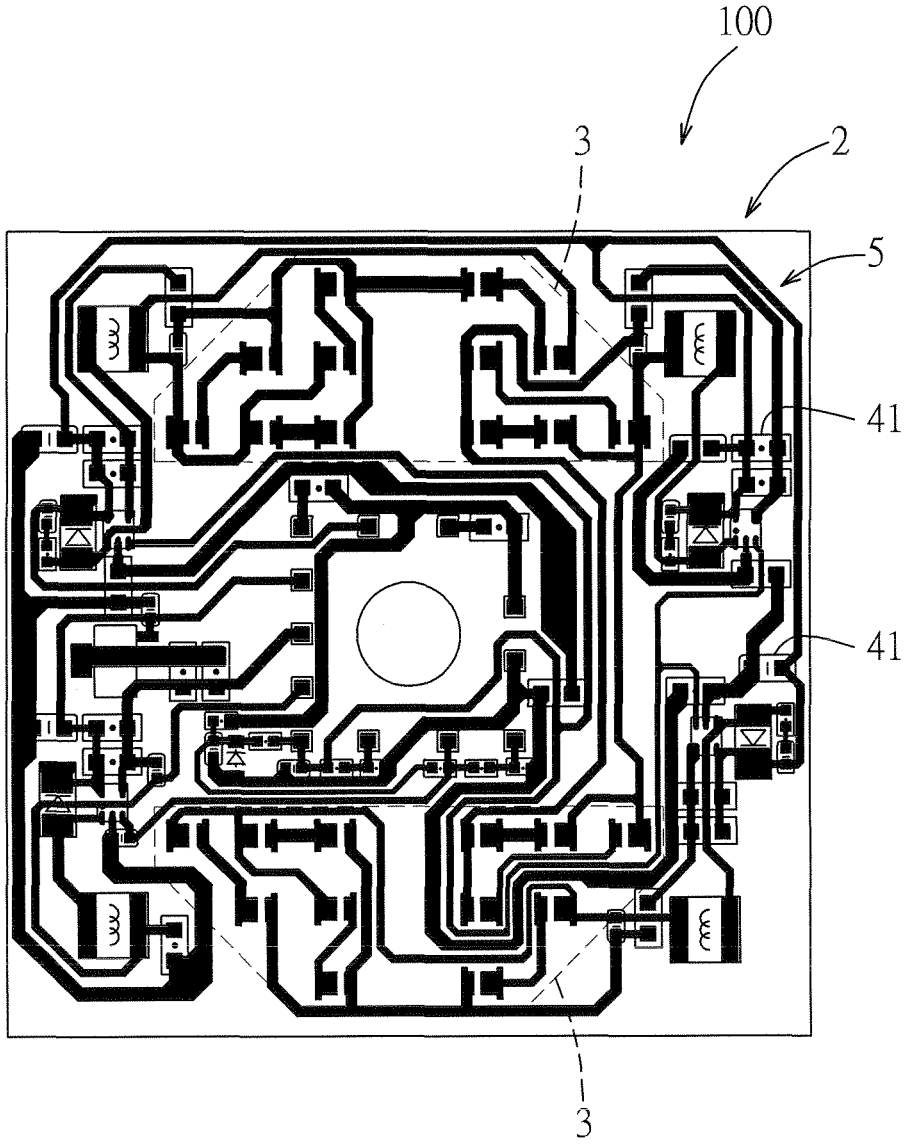
FIG. 4 is a schematic view of the LED module for illustrating a conductive trace on a circuit board of the LED module.

Referring to FIGS. 3 and 4, a preferred embodiment of a light-emitting-diode (LED) module 100 according to the present invention includes a circuit board 2, a pair of LED units 3, a light-adjusting unit 4 and a conductive trace 5.

In this preferred embodiment, the circuit board 2 is in a quadrangular shape having a pair of first opposite side portions 21, a pair of second opposite side portions 22, and a middle portion 23 among the first and second opposite side portions 21, 22. It may be readily appreciated by those skilled in the art that the circuit board 2 may be formed in a round shape or any other shape in other embodiments of the present invention.

The LED units 3 are directly and respectively mounted on the first opposite portions 21 of the circuit board 2, respectively, and are spaced apart from each other for the sake of cooling efficiency. Each of the LED units 3 includes a plurality of LEDs 31. In other embodiments, each of the LED units 3 may include only one LED 31. For example, the LED module 100 may include only one or more than two LED units 3, and the LED units 3 may be mounted at one of the side portions 21, 22 of the circuit board 2 or at the middle portion 23 of the circuit board 2 in other embodiments of the present invention.

The light-adjusting unit 4 is directly mounted on the circuit board 2 at a position distinct from mounting portions of the LED units 3 on the circuit board 2. In this embodiment, the light-adjusting unit 4 is spread out on the second opposite side portions 22 and the middle portion 23 of the circuit board 2. The light-adjusting unit 4 includes a plurality of light-adjusting components 41 for adjusting electric current flowing through the LEDs 31 of the LED units 3. For example, the light-adjusting components 41 may be adjustable resistors and cooperate to adjust the electric current flowing through the LEDs 31 for adjusting brightness of light emitted by the LEDs 31.

The conductive trace 5 is disposed on the circuit board 3 for electrically connecting the LED units 3 to the light-adjusting unit 4. In this preferred embodiment, the circuit hoard 2 and the conductive trace 5 are integrally formed as a printed circuit board as best shown in FIG. 4.

To conclude, mounting the LED units 3 and the light-adjusting unit 4 on the circuit board 2 may facilitate manufacture of the LED module 100 and save manufacturing cost thereof.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

What is claimed is:

1. A light emitting diode module, comprising:

a circuit board having a pair of opposite side portions spaced apart from each other, and a middle portion therebetween;

two light-emitting-diode (LED) units directly and respectively mounted on said opposite side portions of said circuit board;

a light-adjusting unit directly mounted on said middle portion of said circuit board, and operable to adjust electric current flowing through said LED unit; and a conductive trace disposed on said circuit board for electrically connecting said LED unit to said light-adjusting unit.

2. The light emitting diode module as claimed in claim 1, wherein said circuit board and said conductive trace are integrally formed as a printed circuit board.

3. A light emitting diode module comprising:

a circuit board being in a quadrangular shape and having a pair of first opposite side portions, a pair of second opposite side portions, and a middle portion among said first and second side portions;

two light-emitting diode (LED) units directly and respectively mounted on said first opposite side portions of said circuit board;

a light-adjusting unit spread out on said second opposite side portions and said middle portion of said circuit board, and operable to adjust electric current flowing through said LED unit; and a conductive trace disposed on said circuit board for electrically connecting said LED unit to said light-adjusting unit.

4. The light emitting diode module as claimed in claim 3, wherein said circuit board and said conductive trace are integrally formed as a printed circuit board.

* * * * *